United States Patent [19]

Theurer et al.

[11] 4,257,331

[45] Mar. 24, 1981

[54] TRACK SURFACING MACHINE

[75] Inventors: Josef Theurer, Vienna; Friedrich Oellerer, Linz, both of Austria

[73] Assignee: Franz Plasser Bahnbaumaschinen-Industriegesellschaft m.b.H., Vienna, Austria

[21] Appl. No.: 936,213

[22] Filed: Aug. 24, 1978

[30] Foreign Application Priority Data

Oct. 4, 1977 [AT] Austria ..... 7073/77

[51] Int. Cl.[3] ..... E01B 27/10; E01B 27/17

[52] U.S. Cl. ..... 104/2; 37/104; 104/7 B; 104/12; 171/16

[58] Field of Search ..... 104/2, 7 R, 7 A, 7 B, 104/8, 12; 171/16; 37/104

[56] References Cited

U.S. PATENT DOCUMENTS

| | | | |
|---|---|---|---|
| 3,589,298 | 6/1971 | Plasser et al. | 104/12 |
| 3,744,428 | 7/1973 | Plasser et al. | 104/8 X |
| 3,795,198 | 3/1974 | Plasser et al. | 104/7 R X |
| 3,796,160 | 3/1974 | Waters et al. | 104/12 X |
| 3,797,397 | 3/1974 | Eisenmann et al. | 104/12 |
| 3,957,000 | 5/1976 | Plasser et al. | 104/2 X |
| 4,010,691 | 3/1977 | Theurer et al. | 104/7 A |

FOREIGN PATENT DOCUMENTS

| | | |
|---|---|---|
| 13625 | 1/1955 | German Democratic Rep. . |
| 1338600 | 11/1973 | United Kingdom . |

*Primary Examiner*—Randolph A. Reese
*Attorney, Agent, or Firm*—Kurt Kelman

[57] ABSTRACT

A mobile machine arrangement for surfacing a track comprises a ballast excavating chain, a ballast cleaning screen, and conveying devices arranged rearwardly thereof for returning the cleaned ballast into respective ones of the cribs. Thrust tamping tools immersible in the cribs are arranged rearwardly of the ballast returning devices, and a track correction unit is arranged between the ballast excavating chain and the thrust tamping tools for moving the track into a desired position.

8 Claims, 2 Drawing Figures

TRACK SURFACING MACHINE

Figure 1:
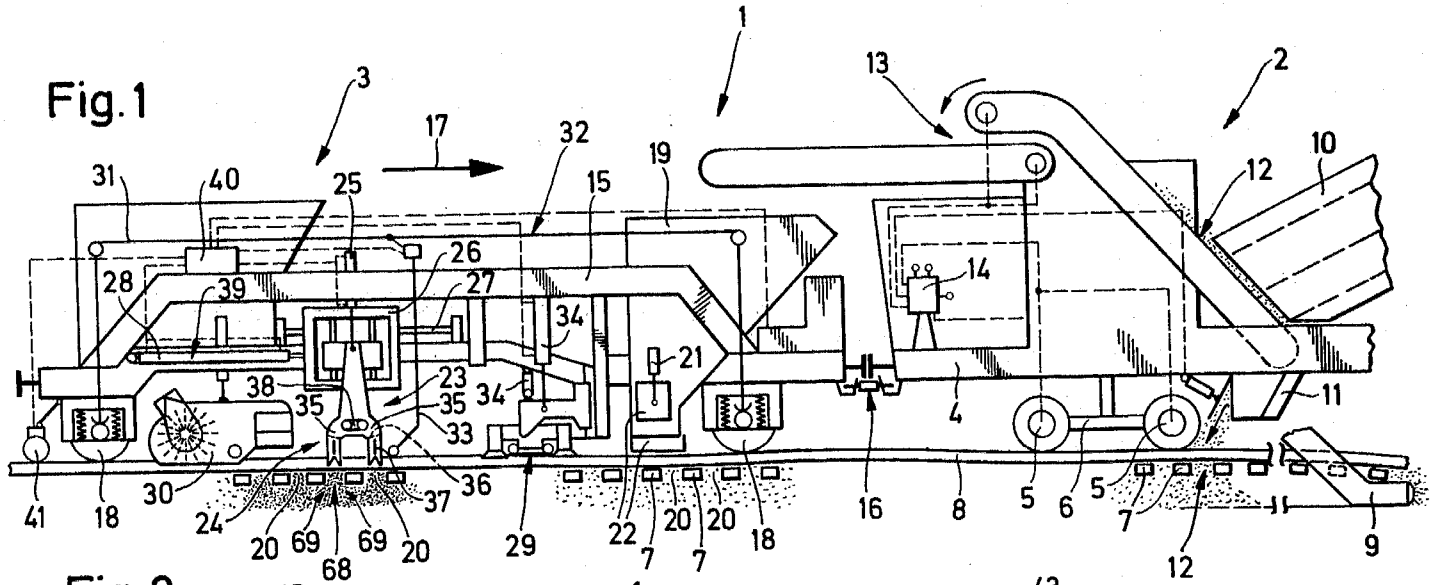

The present invention relates to a mobile machine arrangement for surfacing a track resting on ballast, the track consisting of two rails fastened to ties defining cribs therebetween, and the machine arrangement being adapted to move on the track in an operating direction.

In a continuous operation of a ballast cleaning machine which removes ballast from underneath a track, cleans the ballast and redistributes the cleaned ballast underneath the track and in the cribs, it is generally quite difficult to produce the required ballast stability and compaction for secure positioning of the track thereon in a short time. After cleaning, the ballast bed is relatively loose and after the passage of conventional mobile ballast cleaning machines, such as disclosed, for example, in British Pat. No. 1,338,600, published Nov. 28, 1973, it has been proposed to tamp the ballast with reciprocable tamping tools designed to tamp ballast under the ties when the tools are immersed in the cribs. It has been attempted to impart sufficient support to the ties by such repeated tamping. This type of tamping will considerably reduce the volume of a loose mass of ballast so that it becomes necessary to deliver a considerable amount of ballast underneath the ties. Also, this tamping operation subsequent to the ballast cleaning pass makes it impossible to use the track for train traffic immediately after the ballast cleaning operation. Furthermore, after the ballast has been tamped beneath the ties, subsequent loads on the track will tend to displace the compacted ballast back into the crib areas where the ballast is less compactly packed. This leads to rapid deterioration of the track position, requiring another track surfacing operation after a short time.

U.S. Pat. No. 3,589,298, dated June 29, 1971, discloses surface tamping tools for compacting the ballast in the cribs after it has been tamped underneath the ties.

U.S. Pat. No. 4,010,691, dated Mar. 8, 1977, discloses a ballast leveling apparatus mounted on a ballast cleaning machine to enable the cleaned ballast immediately after redistribution under the track to be smoothed and compacted while the track is lifted thereabove. The track is then lowered onto the leveled and compacted ballast bed, and the ballast may subsequently be tamped with reciprocable tamping tools immersed into the cribs. While this provides an improved ballast bed after a ballast cleaning operation, it is sometimes not quite satisfactory because it is not easy to insert and remove the ballast leveling apparatus into and from the small space available under the lifted track.

U.S. Pat. No. 13,625 of the German Democratic Republic, of Jan. 11, 1955, proposes to mount on the machine frame of a ballast cleaning machine a tamping tool unit with pairs of reciprocable tamping tools, which unit may be moved along guide columns extending in the direction of the track, to enable the ballast to be tamped immediately after it has been cleaned and redistributed. To enable the ballast to be tamped underneath succeeding ties during the continuous advancement of the ballast cleaning machine, the tamping tool unit is displaced during tamping relative to the machine frame. This machine does not solve the problems encountered by uneven and rapid movements, track correction, and delivery of sufficient amounts of clean ballast for proper tamping of the ballast under the ties.

It is the primary object of this invention to provide a track surfacing machine which immediately produces a track ready for high-speed train traffic and which assures high-quality compaction of the ballast bed.

The above and other objects are accomplished in accordance with the invention with a mobile machine arrangement of the first indicated type, which comprises means for removing the ballast, means for cleaning the removed ballast and for returning cleaned ballast into the cribs, additional means arranged rearwardly of the ballast cleaning means in the operating direction for distributing additional clean ballast into respective ones of the cribs, means arranged rearwardly of the additional clean ballast distributing means in this direction for tamping ballast in the cribs, the tamping means having thrust tamping tools immersible in the cribs, and track correction means arranged between the ballast removing means and the thrust tamping tools for moving the track into a desired position.

In another aspect of the present invention, the mobile machine arrangement comprises a machine frame, a drive for moving the machine frame in the operating direction, means for delivering metered amounts of clean ballast into respective ones of the cribs, means mounted on the machine frame rearwardly of the clean ballast delivering means in this direction for correcting the position of the track, a carrier frame mounted on the machine frame rearwardly of the track correcting means in this direction, means for tamping the clean ballast in the cribs mounted on the carrier frame, the tamping means having thrust tamping tools immersible in the cribs, and a reference system associated with the machine frame for controlling the track correcting means.

With a machine arrangement of this type, it has unexpectedly become possible in a simple manner to obtain sufficient ballast compaction immediately after the ballast bed has been excavated and the excavated ballast has been cleaned, this object being obtained by the selected positioning and type of tamping means in the assembly while assuring simultaneously an ample delivery of clean ballast into the cribs. This not only balances the considerable reduction of the ballast volume due to tamping but produces an additional amount of ballast for tamping so that the stability of the tamped ballast will be increased immediately after the cleaned ballast has been redistributed and, if sufficient cleaned ballast is not available, additional clean ballast is distributed with the redistributed cleaned ballast. In the course of this ballasting operation, the track position is corrected and the track is held in the corrected position so that the corrected track is supported on a very stable ballast bed and is capable of supporting train traffic at high speed. Thus, the invention assures a stable track immediately after a ballast cleaning operation.

With the thrust tamping tools immersed in the cribs, a downward pressure or thrust is applied to the ballast so that it is pressed down into the deeper zones in the crib below the level of the ties and into the areas below the ties adjacent to these deeper crib zones. For this purpose, it is particularly useful for the tamping tools to have a relatively large volume immersible into the ballast. Even where the volume of the ballast is considerably reduced during tamping, such tamping tools will produce a cone of compacted ballast in the cribs between the deeper crib zones and the adjacent areas under the ties. This results in a very stable and long lasting ballast bed for a track designed for high-speed traffic. This reduces the need for further track correction and minimizes track settling under heavy train loads.

Figure 2:
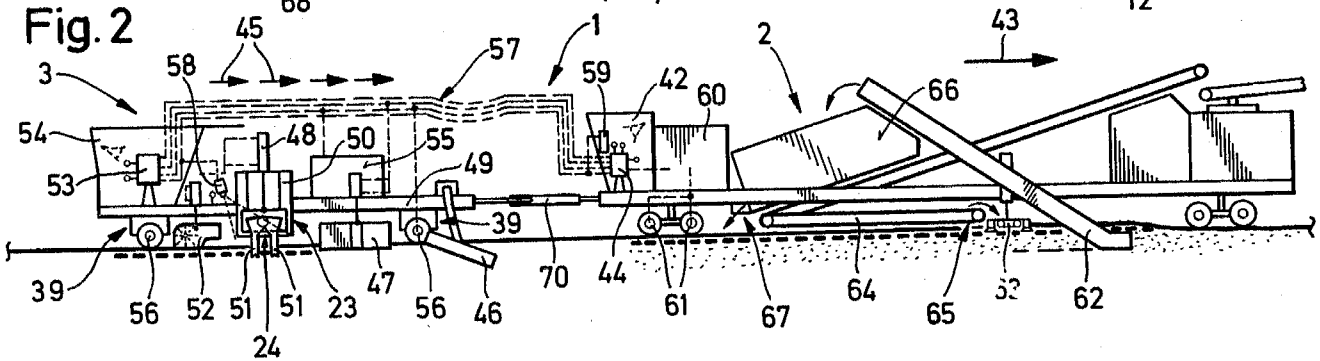

The above and other objects, advantages and features of the present invention will become more apparent from the following detailed description of two now preferred embodiments thereof, taken in conjunction with the accompanying schematic drawing wherein FIG. 1 is a side view of one embodiment of the machine arrangement comprised of a ballast cleaning machine and a ballast tamping machine with track correction means coupled thereto, and FIG. 2 is a like view of another embodiment comprised of a ballast cleaning machine with track correction means and a ballast tamping machine associated with, and controllable from, the ballast cleaning machine but driven independently thereof at a substantially constant distance therefrom.

Referring now to the drawing, wherein like reference numerals in both figures designate like parts functioning in a like manner, and first to FIG. 1, there is shown mobile machine arrangement 1 for surfacing a track resting on ballast, the track consisting of two rails 8 fastened to ties 7 defining cribs 20 therebetween, and the machine arrangement being adapted to move on the track in an operating direction indicated by arrow 17. The mobile machine arrangement illustrated in FIG. 1 comprises ballast cleaning machine 2 (shown only partially) and ballast tamping machine 3. The ballast cleaning machine has a machine frame 4 mounted on undercarriages (only rear undercarriage 6 being shown) for mobility on the track and drive 5 operates the wheels of undercarriage 6 for moving the machine frame in the operating direction. Machine frame 4 of self-propelled ballast cleaning machine 2 carries means 9 for removing ballast, means 10 for cleaning the removed ballast, and means 11 for returning cleaned ballast 12 into the cribs and below ties 7. Such ballast cleaning arrangements are generally conventionally and known, for example, from U.S. Pat. No. 3,957,000, dated May 18, 1976, and U.S. Pat. No. 3,976,142, dated Aug. 24, 1976.

A ballast conveying apparatus 13 comprised of a series of endless conveyor bands is associated with an output of ballast cleaning screen means 10 and extends rearwardly therefrom in the operating direction to convey cleaned ballast away from the cleaning screen.

An operator's cab is mounted at the rear end of machine frame 4 and houses central control panel 14 from which drives for the conveyor bands of apparatus 13, drives 5 for the machine frame and shutters for regulating the discharge of cleaned ballast through chute 11 may be operated.

The ballast tamping machine has another machine frame 15 mounted on undercarriages 18 for mobility on the track and coupled to machine frame 4 for common movement in the operating direction. Coupling 16 between the machine frames may comprise bumpers and a threaded connection. Additional means 19 comprising a ballast storage bin for distributing additional clean ballast into respective ones of cribs 20 is arranged rearwardly of ballast cleaning means 10 in the operating direction. The ballast storage bin has a ballast output chute 22 with a shutter controllable by drive 21 whereby clean ballast may be delivered in metered amounts into cribs 20. If not enough cleaned ballast is delivered from the ballast cleaning means, it is possible to supply additional clean ballast to the storage bin to provide the required amounts of ballast for filling cribs 20.

Means 23 for tamping the ballast in the cribs and under the ties adjacent thereto is arranged between undercarriages 18 and rearwardly of the additional clean ballast distributing means in the operating direction. This tamping means has thrust tamping tools 24 immersible in cribs 20. The tamping tools are vertically adjustably mounted on carrier frame 26 and thrust drive 25 is arranged to press the tamping tools downwardly along vertical columns on the carrier. Displacement drive 39 comprised of hydraulic motor 28 is operable to displace carrier frame 26 in the operating direction relative to the ballast removing, cleaning and distributing means, guide bars 27 extending substantially parallel to the track and mounting the carrier frame on machine frame 15 for displacement. Hydraulic motor 28 is connected between machine frame 15 and carrier frame 26.

Ballast broom 30 is arranged on the tamping machine frame to remove excess ballast from the tamped track.

Track correction means 29 for laterally moving and/or raising the track into a desired position is arranged between ballast removing means 9 and thrust tamping tools 24. Reference system 32 is associated with machine frame 15 for controlling the track correction means for moving the track into the desired position, this conventional reference system comprising reference wire 31 whose ends are supported on the axles of undercarriages 18 running on rails 8 and cooperating with a correction signal pick-up device 33 in the range of the tamping tools, the signal from device 33 controlling drive 34 for track correction means 29. The entire track correction arrangement is entirely conventional.

The term "thrust tamping tools" is used throughout the specification and claims to designate a type of tamping tool capable of being thrust down into the ballast in a crib to tamp the ballast therein in a zone at a level below the ties and to push the ballast at this level sideways under the adjacent ties, such thrust tamping tools being disclosed in U.S. Pat. No. 3,797,397, dated March 19, 1974, whose entire disclosure concerning the tamping tools is incorporated herein by way of reference. Also encompassed by this term are pairs of spreading tamping tools such as disclosed in U.S. Pat. No. 4,094,251, dated June 13, 1978, whose entire disclosure concerning the tamping tools is incorporated herein by way of reference.

The illustrated thrust tamping tools 24 are arranged in pairs for immersion in adjacent cribs 20 and comprise tool heads 35 immersible in the cribs, pressure plates 36 mounted in the tool heads and transverse bar 37 spaced below the pressure plate and affixed by means of at least one support. Vibratory drives 38 are provided for vibrating the tamping tools.

Hydraulic displacement motor 28 as well as hydraulic thrust drive 25, and hydraulic control drives 21 and 34, are connected to control panel 40 in an operator's cabin on tamping machine 3, to which correction signal pick-up 33 is also connected for operation of these operating devices. Odometer 41 is also connected to control panel 40 to determine the continuous speed of movement of machine arrangement 1 in the operating direction. The controlled displaceability of carrier frame 26 for the tamping tools assures proper synchronization of the tamping with the ballast cleaning and distributing operations while all of these operating means are assembled in a single machine arrangement. In the arrangement shown in FIG. 1, the thrust tamping tools may be used during continuous advancement of the machine arrangement while tamping is effected intermittently as well as with an intermittently advancing machine arrangement, the tamping tools being suitably displaced for alignment with the cribs into which they are to be immersed. This arrangement makes it possible to couple together otherwise generally conventional ballast cleaning and tamping machines to assemble them into the machine arrangement of this invention, possibly after minor changes in surface tamper structures used on such conventional tamping machines to convert them to thrust tamping tools.

In the embodiment of FIG. 2, operator's cab 42 is mounted on the machine frame of self-propelled ballast cleaning machine 2 moving continuously in an operating direction indicated by arrow 43 and housing control panel 44. Remote control means 57 indicated by broken lines) are operable from control panel 44 and are connected to various operating means on machine frame 49 of tamping machine 3 for controlling their operation, the tamping machine advancing intermittently, as indicated by arrows 45. The operating means carried on the tamping machine frame comprises thrust tamping tools 24 and independent drive means 56 for intermittently moving machine frame 49 whereby drive means 56 assumes a function equivalent to displacement drive 39 for displacing the tamping means on machine frame 49 in the operating direction in relation to the means 62 for removing the ballast, means 66 for cleaning the ballast and means 65 for distributing the ballast, i.e. the ballast cleaning machine 2. The illustrated operating means on machine frame 49 furthermore includes a centrally positioned ballast plow 47 and laterally extending ballast plows 46 conventionally used in track surfacing.

The thrust tamping tools are vertically movably mounted on carrier frame 50 which is fixedly mounted on machine frame 49, thrust drive 48 being arranged to press the tamping tools downwardly for immersion into the ballast. The tamping tools are mounted on vertical guide columns on the carrier frame and consist of thrust tamping tools 51 arranged in pairs and capable of spreading when immersed in the ballast to force ballast from the cribs under adjacent ties.

Vertically adjustable ballast broom 52 is mounted on machine frames 49 for removing excess ballast from the tamped track and for shaping the ballast bed, the operation of this broom also being remote controllable from control panel 44. A power source, such as hydraulic fluid sump 55, supplies power to the various operating means on tamping machine 3.

Operator's cab 54 on the tamping machine houses control panel 53 which is connected to control panel 44 by remote control line 57, which connection may be switched on or off. The remote control lines are elastic or length-adjustable cables or the like to permit changes in the distance between ballast cleaning machine 2 and ballast tamping machine 3. Television screen 59 in cab 42 is connected to television camera 58 arranged to view the tamping tools to enable an operator in cab 42 to control the operation, i.e. the lowering and centering, of the tamping tools.

Because tamping machine 3 has its own power source 55 and drive means 56, as well as its own control panel, it may be operated independently as well as in assembly with ballast cleaning machine 2 in the illustrated machine arrangement. The ballast cleaning machine also has its own power source 60 and drives 61. Track correction means 63 is mounted on the ballast cleaning machine immediately rearwardly of ballast removing means 62, and the removed ballast is discharged on ballast cleaning screen 66 whence cleaned ballast is delivered to means 65 for returning cleaned ballast into the cribs while the track is held by track correction means 63 in the desired position, the ballast returning means including endless conveyor bands 64. An additional means 67 for distributing additional clean ballast into respective cribs is arranged rearwardly of the ballast cleaning means 66 in the range of the outlet thereof. Ballast plows 46,47 form yet another means for moving ballast into the cribs before tamping tools 24 are immersed in the cribs for compacting the ballast.

Use of thrust twin spreading tools such as disclosed in U.S. Pat. No. 4,094,251, whose large volume penetrating into the ballast causes ballast to be displaced into deeper zones 68 in the cribs to compact the ballast therein, at the same time makes it possible to compact ballast into adjacent zones 69 under the ties by spreading the twin tools in the direction of the track elongation.

Machine arrangement 1 is advantageously operated in the following sequence of steps according to the present invention:

Referring first to the embodiment of FIG. 1, the ballast is removed in a conventional manner by ballast excavating chain 9 and is delivered to ballast cleaning screen 10 where the waste is separated from the cleaned ballast. Cleaned ballast 12 is then distributed, if desired in metered amounts, through chute 11 into the cribs and under the ties, another portion thereof being delivered by conveyor apparatus 13 to storage bin 19 to distribute additional clean ballast in cribs 20. The use of a storage bin for clean ballast makes it possible to store cleaned ballast, which is delivered in uneven amounts as the continuous ballast cleaning operation progresses, and to fill cribs 20 evenly with clean ballast from the bin by suitable operation of outlet shutter 22 by drive 21. If insufficient amounts of cleaned ballast are delivered to storage bin 19 from conveyor apparatus 13, it is possible to feed clean ballast from another source to the bin to provide an adequate supply of clean ballast for filling cribs 20 ahead of the tamping station. The even distribution of cleaned ballast 12 over the entire width of the track below ties 7 is also regulated by controllable shutters.

Immediately after cribs 20 are filled with clean ballast, the track position is corrected, i.e. the track is leveled and/or lined, by track correction unit 29 under the control of reference system 32 and the track is held in the corrected position until the ballast has been compacted by operation of tamping tools 24. The control signal for operation of the track correction unit is emitted from pick-up device 33 in cooperation with reference wire 31 in a conventional manner, and the ballast tamping proceeds by operation of the thrust drive 25 which presses the tamping tools into the ballast, the tamping tools being vibrated to compact the ballast at a level below the ties and to push the ballast at this level sideways under the adjacent ties. During the tamping, displacement drive 39 is operated to displace carrier frame 26 carrying tamping tools 24 with respect to machine frame 15 of tamping machine 3 which continuously advances during the operation with ballast cleaning machine 2 so that the tamping tools are held in alignment with the crib wherein they are immersed. The displacement of the tamping tool carrier frame is synchronized with the forward movement of the machine arrangement in the direction of arrow 17. Upon reaching the desired ballast compaction or after a set tamping time, drive 25 is operated to lift the tamping tools out of the crib and hydraulic motor 28 of displacement drive 39 is operated to move tamping tool carrier frame 26 rapidly in the direction of arrow 17 along guide bars 27 to place the tamping tools above the two succeeding cribs for immersion therein. Hydraulic motor 28 is operated by control 40 in response to the forward speed of machine arrangement 1 in the operating direction, as determined by odometer 41 connected to control 40. If desired, the end positions of carrier frame 26 along guide bars 27 may be set by suitable stops to limit the movement of the carrier frame and, on the other hand, the advance of the carrier frame may be throttled to obtain uniform compaction of the clean ballast if machine arrangement 1 advances too rapidly. While tamping tool heads 35 with their pressure plates 36 are immersed in the ballast during this tamping-in-depth, a large portion of the clean ballast in the crib is pressed into the deeper zone below the level of the ties and is pushed by vibrating transverse bars 37 into the adjacent areas below the ties so as to provide solid support for ties 7 in the corrected position of the track. The simultaneous effect of the downward thrust and the horizontal vibrations of the tamping tools, in connection with the displacement of a relatively large volume of ballast by the immersed tamping tools, produces a very effective compaction of the ballast which is in a fluidized state, due to the vibrations imparted thereto. In other words, the vertical force exerted upon the ballast in crib 20 by operation of thrust drive 25 and the lateral force exerted by transverse bars 37 vibrated by drive 38 combine to move and compact the ballast in deep crib zone 68 and adjacent zones 69 under ties 6, the ballast volume reduced by the compaction of the ballast during this operation being replenished by ballast pushed down by pressure plates 36, as fully described, for example, in U.S. Pat. No. 3,797,397 which discloses such thrust tamping tools.

Preferably, any excess ballast remaining on the track after tamping is removed and the ballast bed is thus suitably shaped by subsequent ballast broom 30 which moves excess ballast to the sides. In this manner, immediately after the surfacing of the track according to the invention has been completed, a fully stabilized track in the correct position and ready to sustain high-speed train traffic has been produced, the track being much more resistant to settling than track surfaced in accordance with conventional methods. The track support by the compacted ballast is much more solid and the track position more accurate than has heretofore been achieved after ballast cleaning, the periods of dead track time being considerably reduced and the total expenditures for the track surfacing work being much less than in conventional procedures.

The surfacing method with the machine arrangement of FIG. 2 differs from that effected with the embodiment of FIG. 1 in that cleaned ballast is returned over the entire width of the track and distributed under the ties by means of conveyor bands 64 mounted on ballast cleaning machine 2 beneath ballast excavating chain 62 and ballast cleaning screen 66 while the track is held in the desired position by track correction unit 63. In this manner, the track assumes the desired position with respect to the machine frame of ballast cleaning machine 2 which serves as the reference system. The additional means 67 for distributing additional clean ballast into respective ones of the cribs until they are filled is arranged in this embodiment in the range of the outlet for the cleaned ballast from ballast cleaning means 66 in front of the rear undercarriage of the ballast cleaning machine.

To obtain a uniform forward movement of machine arrangement 1 in the operating direction indicated by arrow 43, machine frame 49 of tamping machine 3 with tamping tool carrier frame 50, which is immovably mounted thereon, is intermittently advanced along the track, as indicated by arrows 45. This intermittent forward movement of the ballast tamping machine relative to the continuous forward movement of the ballast cleaning machine is accomplished by independent drive 56 for machine frame 49, which thus functions equivalently to displacement drive 39 of FIG. 1 and substitutes such a displacement drive.

A telescoping coupling device 70 may be mounted between the ballast cleaning and tamping machines to determine the distance between machines 2 and 3 at all times so that this distance never exceeds the extension of remote control lines 57. Since control panel 44 for the operation of tamping machine 3 is mounted on continuously advancing ballast cleaning machine 2, the control and operation of the various operating means on the tamping machine may be effected independently of the intermittent forward movement of the tamping machine, which simplifies the work of the operator and thus produces greater efficiency in the tamping operation.

If desired, the tamping means may be mounted directly on the frame of ballast cleaning machine 2, with the use of suitable guide bars 27 for the displacement of the carrier frame for the tamping tools. The same holds for track correction means 29, ballast storage bin 19 and and ballast broom 30 of the embodiment of FIG. 1, or ballast broom 52 of the embodiment of FIG. 2. In other words, a single machine frame may be provided for the cleaning and tamping machines. The machine arrangement of the invention may be used without operatively or structurally coupling tamping machine 3 to cleaning machine 2 for common forward movement but with all operating means being mounted on a single frame continuously advancing along the track in an operating direction. On the other hand, it is also possible to move tamping machine 3 immediately behind, but independently of, cleaning machine 2. It is essential, however, to fill cribs 20 with clean ballast immediately after the ballast has been cleaned so that the thrust tamping tools 24 operate in cribs full of clean ballast, thus producing a highly stabilized track ready for highspeed train traffic after a single working pass including the cleaning of the ballast and tamping of clean ballast in the cribs and under the ties.

What is claimed is:

1. A mobile machine arrangement for surfacing a track resting on ballast, the track consisting of two rails fastened to ties defining cribs therebetween, and the machine arrangement being adapted to move continuously on the track in an operating direction, which comprises the combination of (a) means for removing the ballast, (b) means for cleaning the removed ballast and for returning cleaned ballast under the track ties, and (c) additional means arranged rearwardly of the ballast cleaning means in said direction for filling the cribs with clean ballast, with (d) means arranged rearwardly of the additional means in said direction for tamping the ballast in the cribs filled with clean ballast and under the ties adjacent thereto, the tamping means having (1) thrust tamping tools immersible in the cribs, (e) a displacement drive operable to displace the tamping means in said direction relative to the continuous movement of the ballast removing, cleaning and crib filling means, and (f) track correction means arranged between the ballast removing means and the thrust tamping tools for moving the track into a desired position.

2. The mobile machine arrangement of claim 1, further comprising a carrier frame vertically adjustably mounting the thrust tamping tools, a thrust drive for pressing the tamping tools downwardly, the displacement drive being operable to displace the carrier frame in said direction, and a control for operating the displacement drive for the discontinuous displacement of the carrier frame.

3. The mobile machine arrangement of claim 2, further comprising a machine frame mounted for mobility on the track, and guide bars extending substantially parallel to the track and mounting the carrier frame on the machine frame for displacement, the displacement drive being connected between the machine frame and the carrier frame.

4. The mobile machine arrangement of claim 1, further comprising a vibratory drive for vibrating the tamping tools.

5. The mobile machine arrangement of claim 1 or 4, wherein the tamping tools are arranged in pairs for immersion in adjacent ones of the cribs.

6. The mobile machine arrangement of claim 1, further comprising a machine frame mounted for mobility on the track and carrying the means for removing, cleaning and distributing the ballast, a drive for continuously moving the machine frame in said direction, the machine frame and the means carried thereon being a self-propelled ballast cleaning machine adapted to clean the ballast during continuous movement of the machine in said direction, another machine frame mounted for mobility on the track and carrying the ballast tamping tool carrier frame, and said displacement drive being an independent drive means moving the other machine frame discontinuously whereby the ballast tamping means on the other machine frame is displaceable in said direction in relation to the means for removing, cleaning and distributing the ballast.

7. The mobile machine arrangement of claim 6, comprising a central control panel mounted on the machine frame of the self-propelled ballast cleaning machine, and further comprising remote control transmission means operable from the control panel and connected to the means on the other machine frame for controlling their operation.

8. A mobile machine arrangement for surfacing a track resting of ballast, the track consisting of two rails fastened to ties defining cribs therebetween, and the machine arrangement being adapted to move on the track in an operating direction, which comprises the combination of (a) a machine frame, (b) a drive for moving the machine frame in the operating direction, (c) means for delivering metered amounts of clean ballast into respective ones of said cribs for filling the cribs, with (d) means mounted on the machine frame for correcting the position of the track, (e) a carrier frame mounted on the machine frame rearwardly of the track correcting means in said direction, (f) a displacement drive operable to displace the carrier frame in said direction relative to the machine frame, (g) means for tamping the clean ballast in the cribs filled with clean ballast and under the ties adjacent thereto mounted on the carrier frame, the tamping means having (1) thrust tamping tools immersible in the cribs, and (h) a reference system associated with the machine frame for controlling the track correcting means.

* * * * *